US009187891B2

(12) United States Patent
Aberle

(10) Patent No.: US 9,187,891 B2
(45) Date of Patent: Nov. 17, 2015

(54) SYSTEM AND APPARATUS FOR EVACUATION OF CONTAMINATED FLUIDS FROM FLEXIBLE HULLED VESSELS

(71) Applicant: Tracy Peter Aberle, Redcliff (CA)

(72) Inventor: Tracy Peter Aberle, Redcliff (CA)

( * ) Notice: Subject to any disclaimer, the term of this patent is extended or adjusted under 35 U.S.C. 154(b) by 560 days.

(21) Appl. No.: 13/624,630

(22) Filed: Sep. 21, 2012

(65) Prior Publication Data

US 2013/0146152 A1 Jun. 13, 2013

Related U.S. Application Data

(60) Provisional application No. 61/568,036, filed on Dec. 7, 2011, provisional application No. 61/671,534, filed on Jul. 13, 2012.

(51) Int. Cl.

| | |
|---|---|
| ***F16L 3/00*** | (2006.01) |
| ***E03F 7/10*** | (2006.01) |
| ***E03F 11/00*** | (2006.01) |

(52) U.S. Cl.

CPC ..... *E03F 7/106* (2013.01); *E03F 11/00* (2013.01); *Y10T 137/6851* (2015.04)

(58) Field of Classification Search

CPC ..... E03F 11/00; E03F 7/106; B63B 35/285; B63B 35/303

USPC ..... 137/343; 383/80, 906

See application file for complete search history.

(56) References Cited

U.S. PATENT DOCUMENTS

| | | | | |
|---|---|---|---|---|
| 57,479 | A | | 8/1866 | Church |
| 1,717,764 | A | | 6/1929 | D'Olier |
| 1,924,741 | A | | 8/1933 | Hoopes et al. |
| 2,120,786 | A | | 6/1938 | Jordan |
| 3,040,333 | A | | 6/1962 | Merrill |
| 3,114,384 | A | | 12/1963 | Quase |
| 3,175,887 | A | | 3/1965 | Van Den Berg |
| 3,476,250 | A | | 11/1969 | Fifer |
| 3,893,923 | A | | 7/1975 | Rudzinski |
| 3,897,923 | A | | 8/1975 | Paepke et al. |
| 4,151,075 | A | | 4/1979 | Othmer |
| 4,254,887 | A | * | 3/1981 | Bold ..... 220/723 |
| 4,653,125 | A | | 3/1987 | Porter |
| 5,322,329 | A | | 6/1994 | Michael |
| 5,346,245 | A | | 9/1994 | Budrow et al. |

(Continued)

FOREIGN PATENT DOCUMENTS

| | | |
|---|---|---|
| WO | 02/30831 A1 | 4/2002 |

*Primary Examiner* — John K Fristoe, Jr.

*Assistant Examiner* — Kevin Barss

(74) *Attorney, Agent, or Firm* — Seed IP Law Group PLLC

(57) ABSTRACT

A system for collection, containment, and disposal of contaminated fluids includes a flexible hulled containment vessel having at least one resilient deformable wall and a flow directing apparatus with a body that extends into the containment vessel during use, and an exterior portal that extends from the containment vessel in use. The flow directing apparatus provides fluid communication from an interior of the containment vessel while resisting collapse of the deformable wall during removal of contaminated fluid therefrom. A body of the flow directing apparatus includes side wall apertures spaced along a length thereof, sized to accommodate solids expected to be in the contaminated fluids. Bridge structures help resist collapse. A diameter of the body may be larger than a diameter of the exterior portal, which may further resist collapse. The containment vessel may be foldable for transport or storage.

16 Claims, 7 Drawing Sheets

(56) References Cited

U.S. PATENT DOCUMENTS

| | | | | |
|---|---|---|---|---|
| 5,509,567 | A | 4/1996 | Lindahl | |
| 5,697,515 | A | 12/1997 | Syler et al. | |
| 6,038,710 | A | 3/2000 | Baron | |
| 6,047,736 | A | 4/2000 | Chiocchio et al. | |
| 6,070,751 | A | 6/2000 | Mejias | |
| 6,129,117 | A | 10/2000 | Eriksson | |
| 6,451,268 | B1 | 9/2002 | Erdman | |
| 6,595,382 | B2 | 7/2003 | Ettlinger | |
| 6,598,242 | B1 | 7/2003 | Denome | |
| 6,652,042 | B2 | 11/2003 | Johnson | |
| 7,712,481 | B1 * | 5/2010 | Mayer et al. | 137/351 |
| 2005/0224500 | A1 | 10/2005 | Hebblethwaite | |
| 2008/0219642 | A1 * | 9/2008 | Matloub et al. | 386/95 |

* cited by examiner

SYSTEM AND APPARATUS FOR EVACUATION OF CONTAMINATED FLUIDS FROM FLEXIBLE HULLED VESSELS

FIELD

The present application relates generally to a system for collection and containment of contaminated fluids from temporary service buildings ("TSB"), for example outhouses or portable toilet units, commonly used at events such as concerts and car races, but also used at oil and gas well sites and construction sites.

BACKGROUND

Temporary service buildings are used at various events, locations or sites, for example concerts, auto races, athletic competitions, parade sites, temporary venues, oil and gas well sites, and/or construction sites to name a few. The temporary service building may take a variety of forms, for example outhouses or self-contained portable toilet units. Use of temporary service buildings at event and installation sites generates contaminated fluids, including sewage, which constitute different types and levels of risk to guests, working personnel and the environment. When installed at remote locations, fluids such as sewage have traditionally been drained from or buried on the site where they were generated. Other contaminated fluids, and due to increasing regulation more recently sewage, must be removed from such temporary sites for disposal. When used in populated areas, such fluids are typically removed for treatment and/or disposal.

Typically, fluids are removed (by vacuum truck) periodically and so must be contained between those periods. In the past, building operators or service providers have installed rigid walled boxes or other forms of tank either in the temporary service building or in the ground adjacent to the temporary service building. In some cases a central tank served several temporary service buildings, but more commonly temporary service buildings each had individual holding tanks. Disadvantageously, installing the holding tanks into the temporary service building is more expensive and results in the need to manage and maintain holding tanks on-site. Transporting such holding tanks to and from sites is also inefficient requiring as much space as the volume of fluid storage capacity being moved. Due to the many risks associated with spillage, the holding tanks are traditionally evacuated before they are removed from the site.

Flexible bags capable of holding fluids are also known in the form of industrial wet vacuum technology. These are traditionally a light-gauge, polyethylene or polypropolene construction and so must be supported by a rigid collection tank or similar container in the process of being filled after which the bags are disposed of along with their contents. Such light-gauge or thin skinned bags are not suitable for evacuation by the vacuum trucks used to safely transport contaminated fluids for disposal.

Another known approach employs bags having a cam lock end. When this type of bag was vacuumed out, an insert is used to keep the bag from collapsing in on itself. Basically the insert is a long steel pole with a wide long oval steel cage on the end. The design allows of the pole to be inserted through the cam lock with enough length to support the bag from the inside while the bag is emptied. The cage piece on the end allows the fluid to flow through to a vacuum hose. However, removing this insert after emptying the bag is a very messy process, and put operators at risk of contact with the fluid as well as a chance of accidental release at sites required to be kept free of sewage.

SUMMARY

In order to overcome at least some of the disadvantages of prior approaches relying on rigid-walled tanks, it is desirable to identify an inexpensive, reusable, durable, compact, portable, light-weight, easily installed and serviced vessel to collect and contain contaminated fluids from temporary service buildings, which vessel collapses and folds for transport and storage, yet which may be emptied by vacuum suction.

One aspect may be summarized as a flow directing fluid conduit inserted into and sealingly engaged with a flexible hulled containment vessel sometimes comprised of a PVC bag. The flow directing apparatus ("FDA") includes 3 openings in a length of conduit, which permit fluid to flow into the vessel, but more importantly to be vacuumed out of the vessel while resisting and delaying the collapse of the flexible hull around those 3 openings, avoiding outflow blockage.

Another aspect may be summarized as a system in which operators deliver a plurality of Flexible Hulled Vessels ("FHV"), in the form of folded PVC bags with a filling and draining flow directing conduit already installed and sealed to an empty uncontaminated bag. The delivery of such at fragile event sites can advantageously be made using small vehicles less likely to cause damage to the soil surface, and which smaller vehicles can also access confined spaces more easily than larger equipment. The system for collecting and containing contaminated fluids comprises at least one FHV each in combination with a FDA for fluid coupling to at least one TSB, whereupon the system passively collects and contains contaminated fluids under gravity flow (i.e., using only head pressure) from a TSB into a FHV, in this example a PVC bag. The collection system should be capable of operating in the outdoors subject to ambient weather. Such may mean that operators need to apply supplemental heat Supplemental heat may be preferably supplied using an independent (uninterruptible) power source that prevents freezing of either the fluid couplings between the TSBs and the FHVs as well as the contents of the FHVs. Operators monitor the state of the FHVs and as required periodically evacuate the contents from the FHVs, which (typically constructed of a flexible but resilient thick-walled material) tend to collapse around the point of suction during evacuation. As discussed above, this problem of collapse has been addressed by a number of solutions which disadvantageously require the removal of components on-site and prior to transport. Advantageously the FDA described herein remains sealingly attached to the FHV throughout delivery, installation, filling, evacuation, reuse, re-evacuation, removal and transport away from the site of use for service or re-installation. The design prevents the need to break the seal between the FDA and the FHV, thereby substantially eliminating the risk of any escape of contaminated fluid either over the ground surface of the site of use or any health hazard to any guests, workers and/or operators. To further avoid the risk of any accidental escape of fluid during evacuation, the bags are not moved until draining is complete. The operators simply holdup or support the bag at the corner to prevent spills, disconnect the flex hose from the TSB, and moves the flex hose so as to connect the bag to the vacuum hose on the truck. Even though a hoist is available on the truck, the operator ensures that the bag is not lifted off the ground until the bag is empty. Once the FHVs are safely emptied by evacuation into a vacuum truck tank, the operators either reconnect the FHVs for re-filling, or cap and lift the FHVs via custom hoist and secure such for transport to a cleaning facility before the FHVs are put back into service at a new event or work site for a different customer.

The FHV may include a bag manufactured using ¼" thick PVC sheets, the edges of which are sealed with HH66 PVC cement. This hull material permits the system to operate in an unsecure environment where guests, workers, or operators, or even wildlife are likely to be moving around and could damage hoses or bags, such that durability to resist abrasion, tearing or puncture by people or animals, or deterioration due to the environmental elements (e.g., ultraviolet radiation, low temperatures, temperature cycling) is a factor. Such bags are reusable, and are only replaced if the bags are not working properly or show signs of damage or wear. If a bag has a problem on location, the bag is replaced by a new bag and the damaged bag may be returned for repair. These bags are preferably leak tested periodically (e.g., every three months), and cleaned with a steam cleaner during the summer/winter conversion. During the summer months winter heating tarps are similarly tested and repaired—and otherwise made ready for the winter months. A vacuum truck need only be sent to an event site when the installed equipment needs service, including when the event or working operations are complete and the installed equipment must be removed.

In a further aspect, a hoist is mounted on the vacuum truck to facilitate the collection of all empty bags to transport for cleaning.

The FHV may include, for example 1600 liter bag hulls, which are both impervious to fluid flow and double-walled to provide secondary containment. Leak testing is performed under pressure and the bag hulls are tested to 5 psi. These bag hulls are internally fitted with an FDA that supports the bag from the inside while the bag is being emptied under suction. The emptied bag hull may then be capped for transport. The bag hulls are also outfitted with nylon lifting straps and rings rated suitable for lifting (e.g., rated for a weight of 600 lbs each), so as to allow multiple bags to be lifted using a hoist. The bag hulls may be hoisted without folding by Operators who are removing the bags hulls for cleaning. These bag hulls are also manufactured to easily adapt to receive an insulated winter cover. The insulated winter cover may, for example, be rated for −50° C. temperatures commonly associated with many remote oil and gas sites.

A flow directing apparatus for receiving or evacuating contaminated fluids from the interior compartment of a flexible hulled containment vessel, the apparatus being fluidly coupled to said interior compartment through said flexible hull and sealingly engaged thereto, the apparatus comprising: a portal located exterior to said compartment, having fluid coupling means suitably sized for connection to a sewage vacuum truck hose; a body fluidly coupling said interior compartment through the flexible hull to said portal, whereon the body has three openings located within said compartment, an intermediate aperture, an interior aperture, and an interior portal, said openings substantially aligned with and positioned proximal to one another, but distant from portal; and a bridge located between said intermediate and interior apertures, said bridge for delaying the complete collapse of said flexible hull and thereby blocking said openings during the evacuation of contaminated fluids from said interior compartment.

A fluid collection and containment system, for disposing of contaminated fluids from ecologically sensitive locations, the system comprising: a flexible hulled containment vessel, having resilient foldable walls, for compact transportation and storage; a single point of entry through said flexible hull, having detachable but sealing fluid coupling means, for evacuating a stream of contaminated fluid from within said containment vessel; and a flow directing apparatus, attachable to said fluid coupling means, extending the collection location of said stream inside said containment vessel away from its flexible hull, for resisting the collapse of said flexible hull and resulting restriction of flow during evacuation of contaminated fluid.

A support apparatus for use with a flexible hulled containment vessel having an interior compartment to receive, contain and dispose of contaminated fluids may be summarized as including a fixed frame including at least two substantially parallel arms connected by a transverse cross member, each of the at least two arms coupled opposite the cross member to a vehicle supporting a vacuum receiver vessel; a rotating frame including at least two substantially parallel arms connected by a transverse cross member, each of the rotating frame arms pivotably attached to a respective fixed frame arm, the rotating frame continuously positionable between at least a first position and a second position; at least three fasteners operably coupled to the rotating frame cross member, the at least three fasteners to receive a respective number of complimentary fasteners on the flexible hulled containment vessel; and a driver operably coupled to the rotating frame to reversibly position the rotating frame between at least the first position and the second position, the driver including at least one isolation device to halt the driver and maintain the rotating frame in a fixed position.

The driver may include a winch subsystem, the winch subsystem including a base member operably coupled to an exterior surface of the vacuum receiver vessel, a flexible member having a first end operably coupled to the rotating frame, and a rotating drum fixedly attached to a second end of the flexible member. The at least one isolation device may include a device to isolate the winch subsystem from a power supply. The power supply may include an electrical power supply generated by the vehicle. Each of the at least three fasteners may include a hook. Each of the at least three hooks may rotate about a longitudinal axis defined by the rotating frame cross member. Each of the rotating frame arms may pivot about a shaft member coupled to the fixed frame by a plurality of support members. The support apparatus may further include a rigid brace operably coupling the winch subsystem to the fixed frame cross member. When in the first position, the rotating frame may be proximate the fixed frame and when in the second position the rotating frame may be distal from the fixed frame.

The accompanying drawings, which are incorporated in and constitute a part of this specification, illustrate preferred embodiments of the apparatus and system according to the invention and, together with the description, serve to explain the principles of the invention.

BRIEF DESCRIPTION OF THE DRAWINGS

In the drawings, identical reference numbers identify similar elements or acts. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE PREFERRED EMBODIMENT

In the following description, certain specific details are set forth in order to provide a thorough understanding of various disclosed embodiments. However, one skilled in the relevant art will recognize that embodiments may be practiced without one or more of these specific details, or with other methods, components, materials, etc. In other instances, well-known structures associated with collection, containment, and disposal systems and associated structures have not been shown or described in detail to avoid unnecessarily obscuring descriptions of the embodiments.

Unless the context requires otherwise, throughout the specification and claims which follow, the word "comprise" and variations thereof, such as, "comprises" and "comprising" are to be construed in an open, inclusive sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and "the" include plural referents unless the content clearly dictates otherwise. It should also be noted that the term "or" is generally employed in its broadest sense, that is as meaning "and/or" unless the content clearly dictates otherwise.

The headings and Abstract of the Disclosure provided herein are for convenience only and do not interpret the scope or meaning of the embodiments.

Figure 1A:
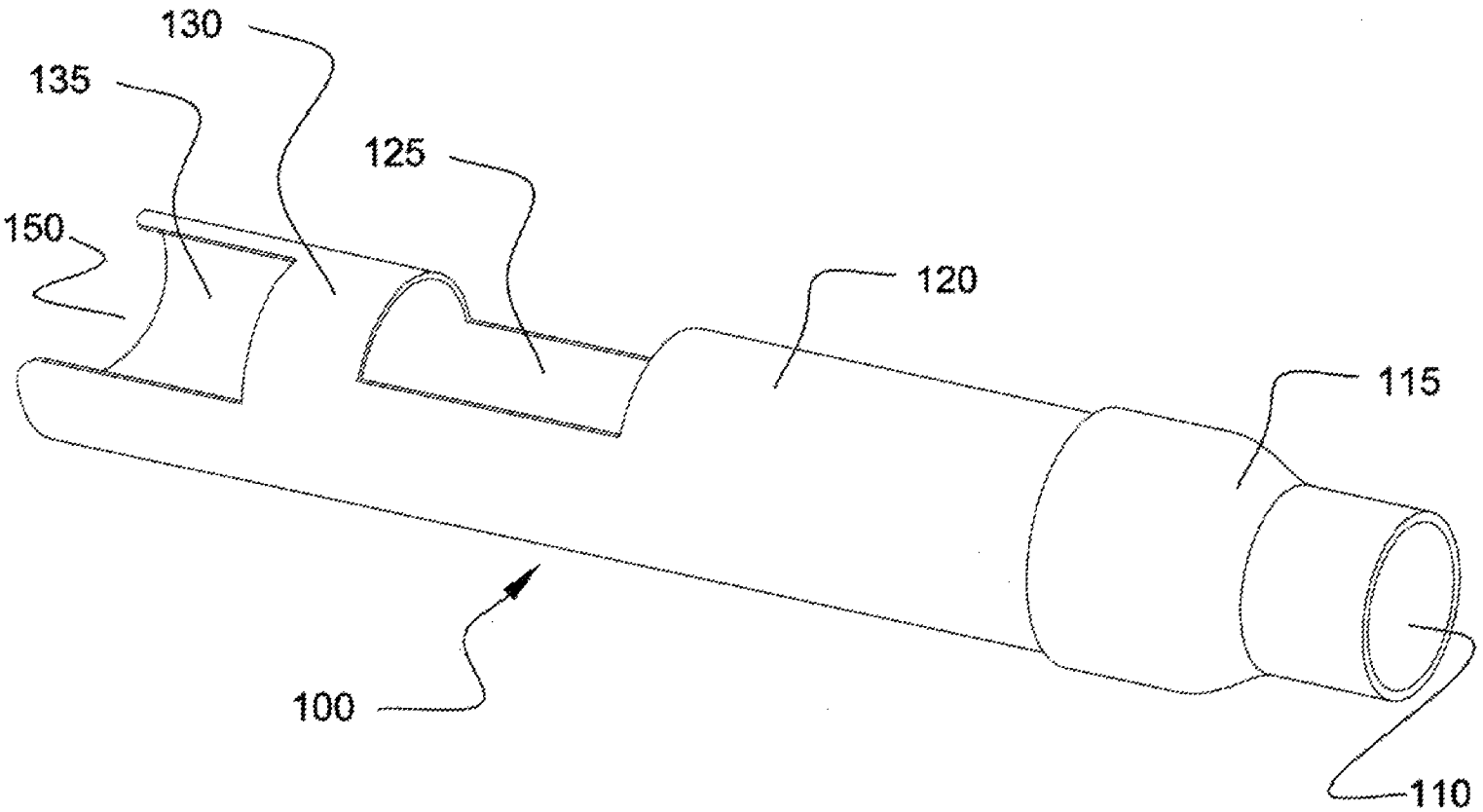
FIG. 1A is an isometric view of a flow directing apparatus, according to one illustrated embodiment, having a body with a pair of apertures circumferentially aligned with one another about a principal axis of the body.
Figure 1B:
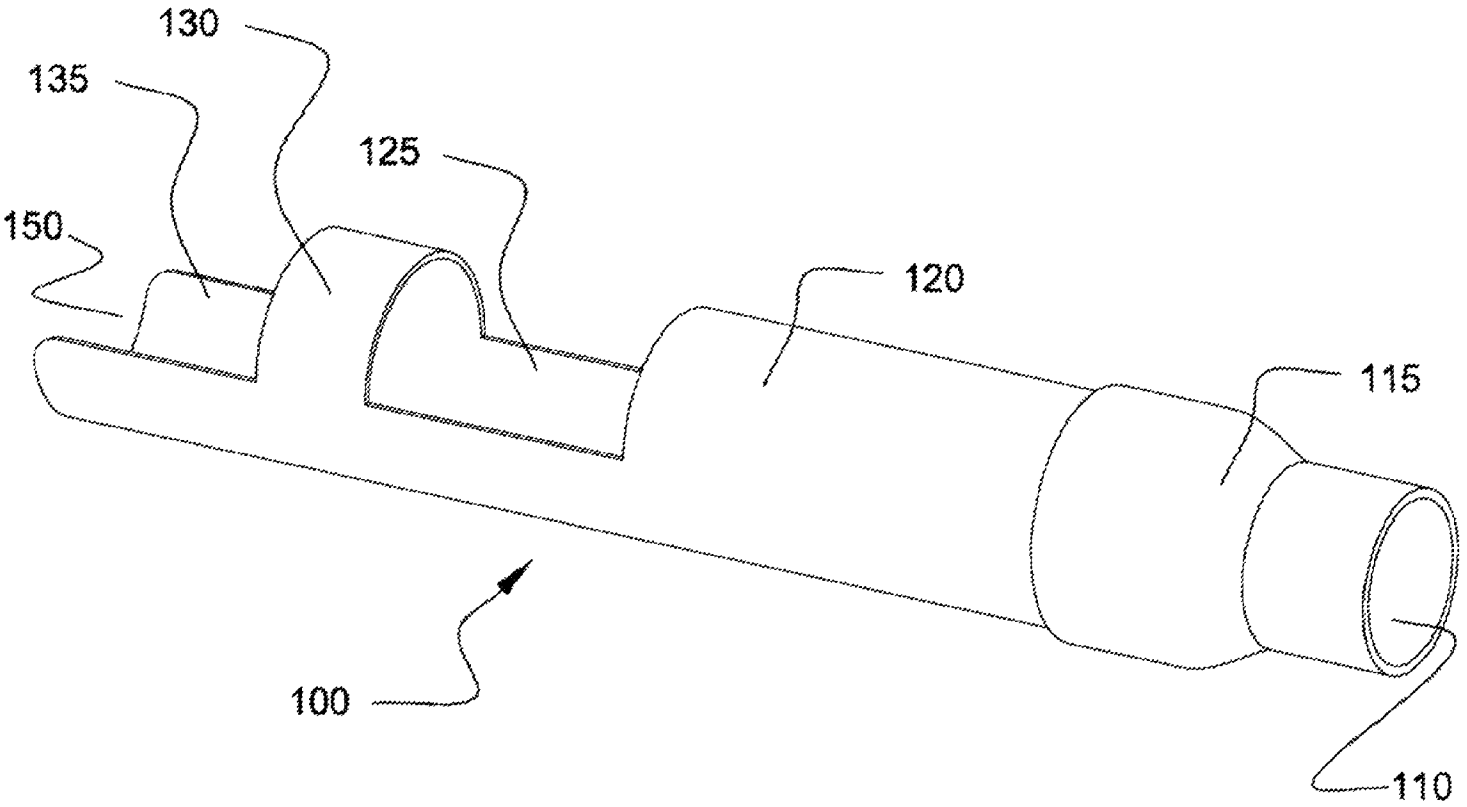
FIG. 1B is an isometric view of a flow directing apparatus, according to another illustrated embodiment, having a body with a pair of apertures circumferentially offset with respect one another about a principal axis of the body.

FIGS. 1A and 1B show flow directing apparatus 100A and 100B (collectively 100), according to respective illustrated embodiments.

The flow directing apparatus 100 has at a first or proximal end, an exterior portal 110 sized to fluidly couple to any standard-sized vacuum truck hose during evacuation. Fluidly coupled to exterior portal 110 is a body 120 in the form of a tube or conduit. The body 120 may have a cylindrical shape, with a circular cross section, or may have some other shape. The body 120 will have a substantially larger diameter than a diameter of the exterior portal 110. For example, the body 120 will typically have a diameter of at least 3 inches. The body typically is formed of a plastic such as a PVC or ABS plastic.

Body 120 provides a rigid walled plenum into and through which fluids may be evacuated by a standard sewage vacuum truck, without risk of internal blockage. A larger diameter body 120 with greater capacity will have some advantage over a smaller diameter body, but depending on the size of the solids being processed there will eventually be a diminishing return with increased size. It is contemplated that with body 120 having a larger (than portal 110) internal diameter this tends to create a plenum area of reduced suction helping the walls of the bag based embodiment from collapsing on themselves.

Whether fabricated from "off the shelf" components (as shown) or custom molded as a single apparatus, the specific transition passage 115 from the diameter of portal 110 to body 120 is simply whatever is useful to mate the larger body to a hose which is sized for the collection of fluids from a TSB or evacuation to a disposal truck.

The body 120 is open at a proximal end, and optionally open 150 at a distal end, with a passage extending therebetween to provide fluid communication. The body includes at least two side wall apertures which may be either cut from or molded into the body 120. Only two apertures are illustrated, intermediate aperture 125 and interior aperture 135. The interior aperture 135 may be proximate the distal end of the body, while the intermediate aperture 125 is positioned along a length of the body 120 between the proximal and distal ends. The intermediate aperture is sized to accommodate the passage of any solids typical to the nature of the contaminated fluids being collected. In the application of human waste disposal, aperture 125 suitable dimensions would be approximately 6" long and approximately 90 degrees wide about a periphery or circumference of a 3" diameter body. For such applications, the body may advantageously have a length of under 30 inches, for example a length of 29 inches. It will of course be understood by a person of skill in the art of waste collection that the precise size of the opening that is aperture 125 is often not critical.

Uncut segments of body 120 between the successive ones of each pair of apertures 125, 135 forms a bridge 130 (only one illustrated). The bridge 130 supports the flexible hull of a containment vessel (not shown in FIG. 1A or 1B) from inside, so as to prevent the blockage of aperture 125 during the evacuation of the containment vessel under the pressure of vacuum. Secondly, interior aperture 135, similarly sized to accommodate the passage of typical solids, is created at or proximate to the interior or distal end of the body 120, for instance as shown in FIGS. 1A and 1B. As shown in FIGS. 1A and 1B, aperture 135 may be coincident with interior portal 150. Alternatively, aperture 135 and portal 150 may be separated by a second bridge (not shown).

To achieve better advantage, the body 120 of apparatus 100 is preferably of any suitable length relative to a length of the FHV, so as to extend sufficiently far inside its FHV that the combination are able to resist collapse around the point of entry where apparatus 100 is sealingly engaged to the FHV through the hull. Moreover, while the relative angle between apertures 125 and 135 is not essential, it is preferable that these openings be created along the same side of body 120. For example, the apertures 125 and 135 may be circumferentially aligned about a principal axis (e.g., longitudinal axis) of the body 120, as illustrated in FIG. 1A. Alternatively, the apertures 125 and 135 may be circumferentially offset with respect to one another about a principal axis (e.g., longitudinal axis) of the body 120, for instance as illustrated in FIG. 1B.

Similarly, the length of the bridge 130 separating openings 125 and 135 is not essential. However, it is desirable to have opening 125 well inside the FHV so as to increase the distance between the initial point of suction and the hull of the FHV, thereby better avoiding the risk of collapse over aperture 125.

A FHV may be provided in combination with a flow directing apparatus. Such a system may be folded or collapsible, and advantageously transported in a pickup truck run by a single operator servicing the installation site. As further set out below, the FHV is durable and resistant to accidental puncture from animals and guests or workers such that the FHV need not be buried. In the surface mounted operation of the system, one FHV lays on the ground adjacent each of the TSBs at the site. The FHV is fluidly coupled to the TSB using a flexible tube or hose laid out in any suitable manner that permits contaminated fluids to flow out of the TSB and into the FHV under the force of gravity, preferably taking advantage of any slope available in the terrain adjacent the TSB.

The fluid conduit FDA extends inside the FHV any suitable distance to channel the flow of CF away from exterior portal 110 to resist plugging and the associated back pressure, during filling. The body 120 also tends to bias the interior portions of the hull of the FHV to remain apart so as not to collapse together over the openings in the apparatus, thereby permitting the free flow of CF into the FHV until it is substantially full. It may be beneficial to limit a length of the body 120 to approximately ¼ of the length of the FHV into which the body 120 is installed. Such may permit the FHV to be folded onto itself 3 times into 4 quarters. This allows large numbers of portable FHVs to be transported using a standard bed of a full-sized pickup truck at the time of installation and removal from event or work sites. For the purpose of such compact folding, a convenient size for the FHV has been determined to be 118" long when used with a FDA that is 29" long.

A person of skill in the art would understand that for longer term installations at larger installation sites having easy access to the drains from the TSBs for larger trucks, would permit operators to use FHVs of larger dimensions that could be serviced with the assistance of an appropriately sized truck-mounted crane or hoist. Moreover, when a single operator is evacuating the CF from the normally sized of the FHV using the suction of a vacuum truck (the outflow hose of which truck is substituted for the inflow hose from the TSB) the apparatus has at least one elongate intermediate aperture 125 isolated by a conduit bridge from a second partly shielded interior aperture 135, thereby comprising two openings through which CF may be drawn under suction (typically 20 psi) to empty each FHV on that site. Advantageously, this may allow a single operator to lift the various edges of the FHV to facilitate evacuation of the CF by helping to direct the FHV's contents towards the apertures. As the FHV is nearly empty, portions of the flexible hull will tend to first collapse around interior aperture 135 under the force of the suction of the vacuum truck, the complete closure of which is resisted by both: the tail stock of body 120 from which interior aperture 135 has been created, and the durable resilient material from which the FMV has been fabricated.

In operation, as the FHV is evacuated, elongate intermediate aperture 125 tends to remain open the longest—in part because its orientation inside the FHV requires the highest level of vacuum to draw the relatively thick walled PVC bag around the flow directing apparatus before completely sealing intermediate aperture 125 from further fluid flow. It is the empirically determined combination of: a) the size of the two openings in the flow directing apparatus, and b) the installation orientation and relative alignment of the openings away from the walls of the FHV, which when applied with the (semi-pliable) thick resilient material used to fabricate the bag sufficiently resist collapse under the low level of vacuum common to the sewage removal industry, so as to permit the substantial evacuation of the bag without the need to insert, remove and clean the screen components of earlier designs.

Figure 2:
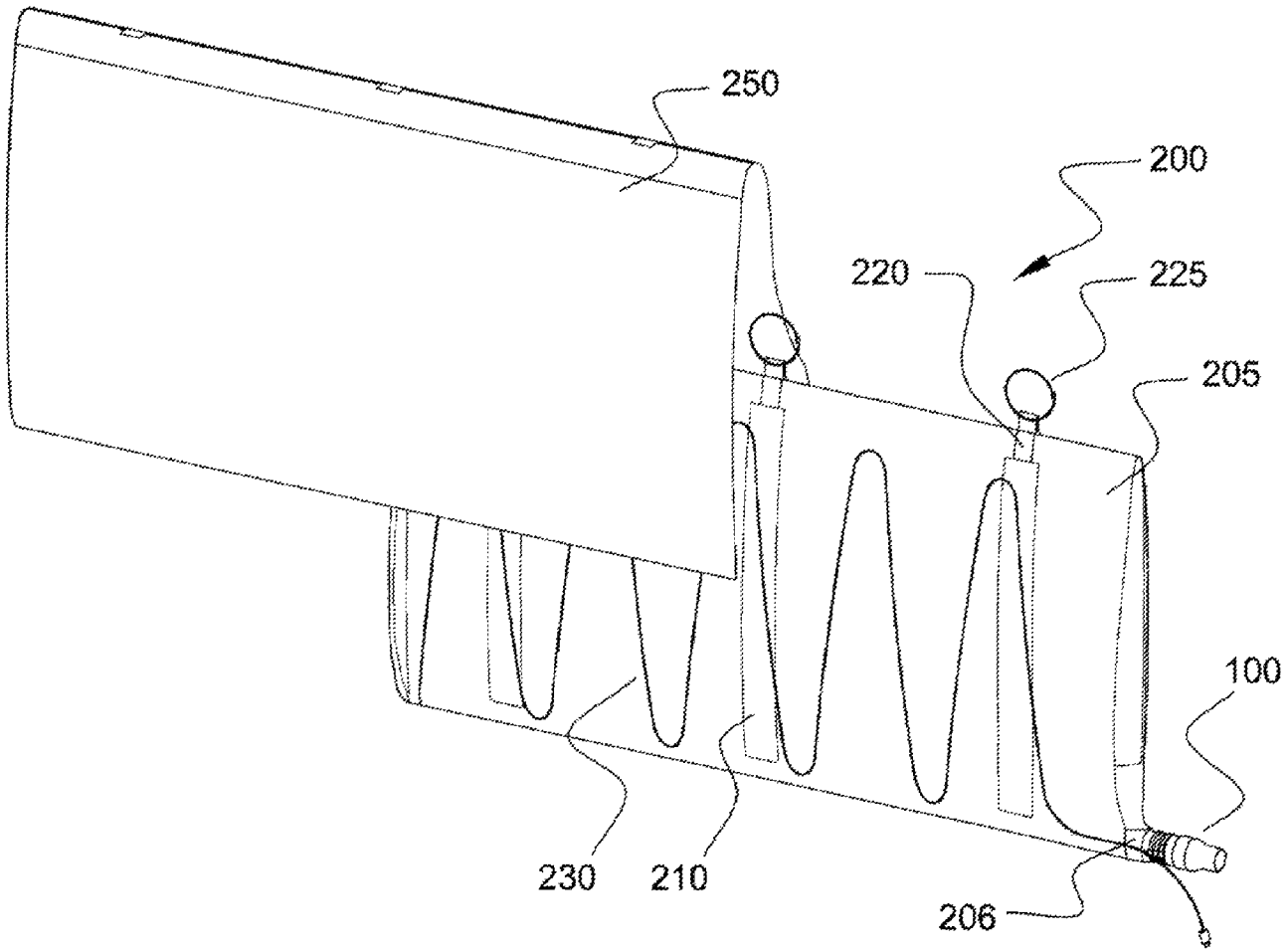
FIG. 2 is a perspective view of a collection, containment and disposal system having a flexible hulled vessel and a flow directing apparatus received at least partially therein, according to one illustrated embodiment.

FIG. 2 shows a collection, containment, and disposal system 200, according to one illustrated embodiment. The collection, containment, and disposal system 200 includes a flow directing apparatus 100, received into a flexible hulled vessel 205 having a port with a coupler 206 through which apparatus 100 is sealingly engaged to the hull and fluidly coupled to the interior compartment (not shown).

As illustrated therein, flexible hulled vessel 205 is a PVC bag, having the thick, pliable and resilient walls. The walls are reinforced by reinforcement strips 210 at multiple locations. Attaching straps 220 and lifting rings 225 may be are provided reinforcement strips 210 for suspending the flexible hulled vessel (e.g., bag) 205 during transport and cleaning. When the flexible hulled vessel 205 are used in winter conditions Optionally, heating tape 230 may be applied to the exterior of flexible hulled vessel 205 to allow heating during winter conditions. Heating tape may take a variety of forms, typically including an electrically resistive trace, wire or material which generates heat in response to an application of an electrical current. Optionally, a thermal blanket 250 may also be fitted to the exterior of the flexible hulled vessel 205. The thermal blanket 250 may be located over the heating tape 230, to reduce heat loss to the ambient environment.

Figure 3:
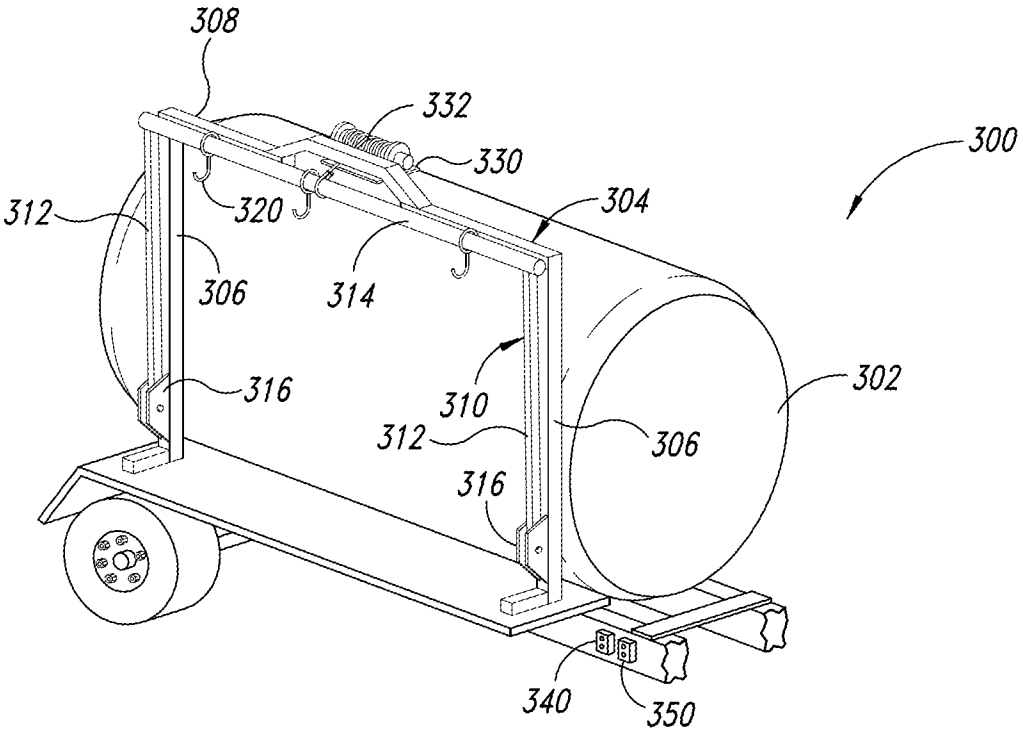
FIG. 3 is a perspective view of a boom apparatus to lift and drain a flexible hulled vessel into a vacuum receiver vessel, the boom apparatus is depicted in a stowed or travel position.

FIG. 3 shows an example boom apparatus 300 useful for lifting the flexible hulled vessel 205 described above into a first position where contaminated fluids can be drained from the flexible hulled vessel 205 into a receiver 302, for example a vacuum receiver vessel mounted on a vehicular chassis. The boom apparatus 300 can include a fixed frame 304 and a rotating frame 310 that is pivotably attached to the fixed frame 304 by one or more pivotable connections 316. A driver 330 is used to assist in positioning the rotating frame 310 between the first position proximate the fixed frame 304 and a second position distal from the fixed frame 304.

In at least some instances, the fixed frame 304 can include at least two substantially parallel arms 306 connected by at least one transverse cross member 308. Each of the two substantially parallel arms 306 can be coupled to a frame or structure supporting the receiver vessel 302. In at least some instances, at least a portion of the frame or structure can include a vehicle or a portion thereof. In at least some instances, the receiver vessel 302 can include a vacuum receiver vessel configured to receive contaminated fluid transferred under vacuum from a flexible hulled vessel 205.

The two substantially parallel arms 306 and the at least one transverse cross member 308 forming the fixed frame 304 may be fabricated from any metallic or non-metallic material having suitable strength and rigidity. In at least some instances, all or a portion of the fixed frame 304 may be constructed with Schedule 80 steel pipe. In other instances, other heavy or light wall steel tubing or structural shapes may be used. In at least some instances, gussets may be provided, for example where the transverse cross member 308 attaches to each of the substantially parallel arms 306 or where each of the substantially parallel arms 306 attaches to the vehicle.

The rotating frame 310 can include at least two substantially parallel arms 312 connected by at least one transverse cross member 314. Each of the two substantially parallel arms 312 may be pivotably coupled to the fixed frame 304 by one or more pivotable connections 316. In some instances, the one or more pivotable connections 316 may be at an intermediate point on each of the arms 306, for example between the point of connection of each of the arms 306 to the vehicle and the transverse cross member 308. In some instances, all or a portion of the pivotable connections 316 may be coupled or otherwise attached to the vehicle rather than the arms 306. In at least some instances, the pivotable connection 316 can permit the rotation of the rotating frame 310 through an arc of motion measured with respect to the fixed frame 304 that is greater than about 90°, greater than about 115°, greater than about 130°, or greater than about 145°.

The two substantially parallel arms 312 and the at least one transverse cross member 314 forming the rotating frame 310 may be fabricated from any metallic or non-metallic material having suitable strength and rigidity. In at least some instances, all or a portion of the rotating frame 310 may be constructed with schedule 80 steel pipe. In other instances, other heavy or light wall steel tubing or structural shapes may be used. In at least some instances, gussets may be provided, for example where the transverse cross member 314 attaches to each of the substantially parallel arms 312.

In at least some instances, the pivotable connection 316 can include a plurality of spaced support members carrying a shaft or trunnions that support or are attached to, or pass at least partially through, the rotating frame 310. In at least some instances, the plurality of spaced support members forming the pivotable connection 316 may be affixed temporarily (e.g., through the use of threaded fasteners) or permanently (e.g., through welding) to the fixed frame arms 306. In at least some instances, the rotating frame 310 can rotate freely about a shaft member that is carried by the plurality of spaced support members. In some instances, one or more bearings or similar friction reducing devices may be disposed between the shaft and the fixed frame 304 or the rotating frame 310 and the shaft. In some instances, one or more bearings or similar friction reducing devices may be disposed between the trunnions mounted on the rotating frame 310 and the fixed frame 304.

One or more drivers 330 may be operably coupled to at least the rotating frame 310 to reversibly position the rotating frame 310 between at least the first position and the second position. The one or more drivers 330 may be electrically, mechanically, or pneumatically driven, powered, or operated. In some instances, the one or more drivers 330 may be electrically operated using one or more vehicular mounted electrical systems or generators. In other instances, the one or more drivers 330 may be mechanically operated, for example via a power take-off (PTO) coupled to a vehicular engine via one or more power transmission devices. In yet other instances, the one or more drivers 330 may be pneumatically operated, for example using one or more vehicular pneumatic systems. In at least some instances, the one or more drivers 330 may include one or more clutches, ratcheting assemblies or the like to control, limit, or otherwise restrict the movement or rotation of the rotating frame 310. Such clutches or ratcheting assemblies may permit the rotating frame 310 to remain in a fixed position upon failure of, or loss of power to, the one or more drivers 330.

The one or more drivers 330 may be removably or permanently attached to the vacuum receiver vessel 302. For example, in some instances, the one or more drivers 330 may be positioned on a base member which is attached to the vacuum receiver vessel. In at least some instances, one or more braces or similar structural members may be coupled to the one or more drivers 330, the base supporting the one or more drivers 330, and the fixed frame 304.

Although the one or more drivers 330 are shown as a cable or chain winch in FIG. 3, any device capable of pivoting the rotating frame 310 at least partially through an arc about the pivotable connections 316 may be similarly employed. For example, in some instances a direct drive electric motor may be operably coupled to the rotating frame 310 through a transmission, gear reduction, or belt drive assembly. In other instances, a cable winch having a rated capacity of no less than about 5,000 lbs. force, no less than about 10,000 lbs. force, no less than about 15,000 lbs. force, no less than about 20,000 lbs. force, no less than about 25,000 lbs. force, or no less than about 30,000 lbs. force, may be operably coupled to the rotating frame 310. A first end of a flexible member 332 (e.g., cable or chain) from the driver 330 may be attached or otherwise coupled to the rotating frame 310 at one or more points, preferably near the mid-point of the transverse cross member 314, although other connection points may be used. In some instances, the flexible member from the driver 330 may be attached to the rotating frame 310 at multiple points using a yoke or spreader bar assembly. In at least some instances a second end of the flexible member may be attached to the driver 330. In some instances, the second end of the flexible member 332 can be attached to a rotating drum in the driver 330.

One or more driver controls 340 (e.g., pushbuttons, dials, knobs, indicators, etc.) may be mounted in a location proximate the fixed frame 304 that is accessible from grade. For example, in at least some instances, the fixed frame 304 may be mounted on a vehicle fender proximate a vacuum receiver 302 mounted on the vehicle frame. In such an instance, one or more driver controls 340 may be mounted on or near the vehicle fender, proximate the fixed frame 304, yet at a safe distance from the rotating frame 310. Such driver controls 340 may include one or more devices configured to cause the driver 330 to lower the rotating frame 310 towards the second position distal from the fixed frame 304, and one or more devices configured to cause the driver 330 to raise the rotating frame 310 towards the first position proximate the fixed frame 304. In at least some instances, one or more driver emergency shutoff controls 350 may also be mounted proximate the one or more driver controls. Such emergency shutoff controls 350 may isolate the driver 330 from the power supply (e.g., open a switch on an electrical power supply, vent or dump a pneumatic power supply, or disengage a mechanical power supply).

At least three fasteners 320 may be operably coupled to the rotating frame 310. The at least three fasteners 320 are configured to receive at least three complimentary fasteners on the flexible hulled vessel 205 to detachably attach the flexible hulled vessel 205 to the rotating frame 310. In at least one instance, the at least three fasteners 320 can be rotatably mounted to the transverse cross member 314 such that the at least three fasteners are able to rotate about a longitudinal axis of the transverse cross member 314. Permitting the fasteners 320 to rotate about the transverse cross member 314 can advantageously permit the receipt of the complimentary fasteners on the flexible hulled vessel 205. Permitting the fasteners 320 to rotate about the transverse cross member 314 can also reduce stress on the flexible hulled vessel 205 as the rotating frame 310 is raised by permitting the flexible hulled vessel 205 to hang plumb throughout the lifting process. In at least some instances, the at least three fasteners 320 can each include one or more open hooks and the complimentary fasteners on the flexible hulled vessel 205 can include an equal or greater number of closed loops that are configured to receive the open hooks.

Figure 4:
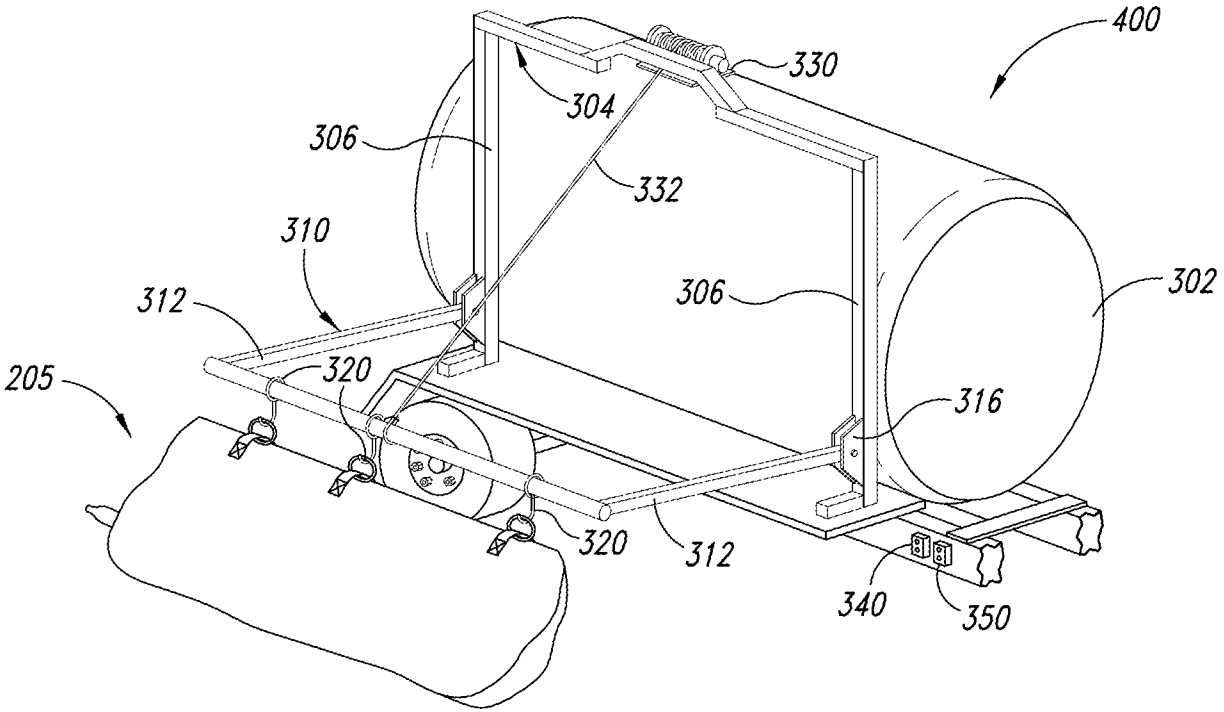
FIG. 4 is a perspective view of a boom apparatus to lift and drain a flexible hulled vessel into a vacuum receiver vessel, the boom apparatus is depicted in a deployed position coupled to an example flexible hulled vessel.

FIG. 4 shows an illustrative boom apparatus 300 deployed in the second position, distal from the fixed frame 304, that permits the attachment of a flexible hulled vessel 205 to the rotating frame 310. In at least some instances, the flexible hulled vessel 205 may be operably coupled to the rotating frame 310 via the at least three fasteners 320. In at least some instances, the flexible hulled vessel 205 will be on the ground and at least partially filled with a contaminated liquid prior to attachment to the rotating frame 310. Placing the rotating frame 310 in the second position where the at least three fasteners 320 are proximate the complimentary fasteners on the flexible hulled vessel 205 advantageously permits the coupling of the flexible hulled vessel 205 to the rotating frame without requiring lifting or repositioning of the flexible hulled vessel 205. By eliminating the need to lift or reposition the flexible hulled vessel 205 prior to attachment to the rotating frame 310, exposure to the contaminated fluids within the flexible hulled vessel 205 is reduced or eliminated.

Figure 5:
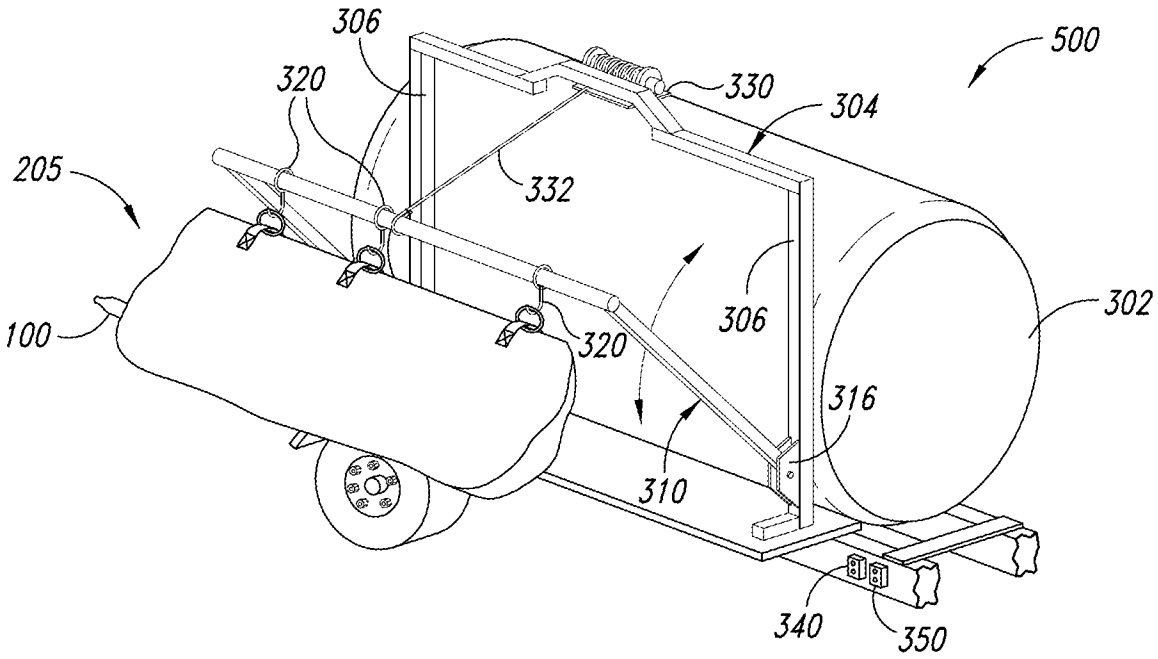
FIG. 5 is a perspective view of a boom apparatus to lift and drain a flexible hulled vessel into a vacuum receiver vessel, the boom apparatus is depicted in a deployed position coupled to an example flexible hulled vessel and lifting the flexible hulled vessel to a drain position.

FIG. 5 shows an illustrative boom apparatus 300 transitioning from the second position to the first position proximate the fixed frame 304 permitting the discharge of the contaminated fluid contained in the flexible hulled vessel 205 to the vacuum receiver vessel 302. In at least some instances, the driver 330 can rotate the rotating frame 310 in an upward direction to transition the rotating frame 310 from the second position to the first position. As the rotating frame 310 is raised, the flexible hulled vessel 205 containing the contaminated fluid is lifted from the ground as depicted in FIG. 5. Since the flexible hulled vessel 205 contains a flow directing apparatus 100 that is positioned opposite the complimentary fasteners, lifting the flexible hulled vessel 205 can cause any contaminated fluid contained therein to accumulate in the portion of the vessel proximate the flow directing apparatus 100.

Figure 6:
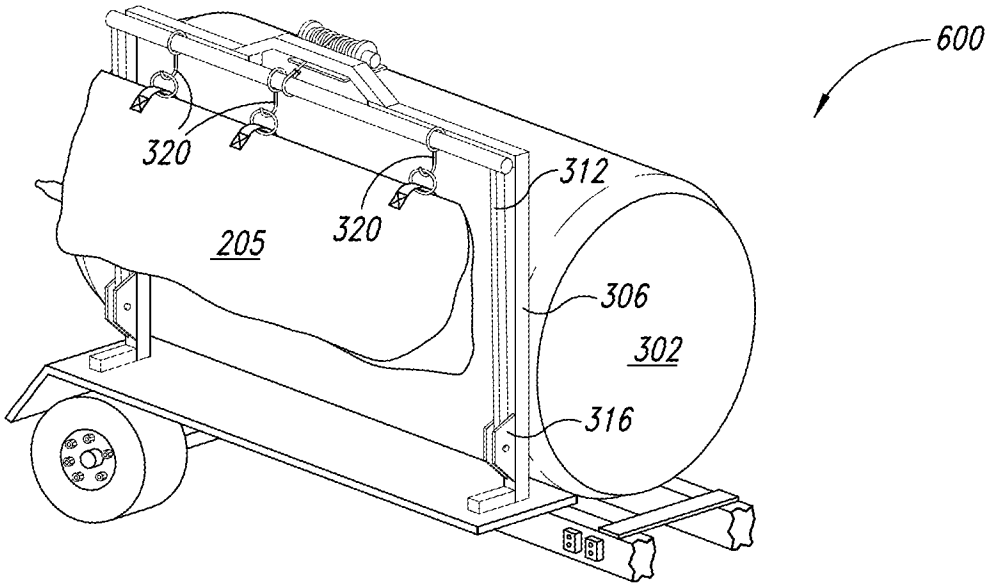
FIG. 6 is a perspective view of a boom apparatus to lift and drain a flexible hulled vessel into a vacuum receiver vessel, the boom apparatus is depicted in a deployed position coupled to an example flexible hulled vessel with the flexible hulled vessel positioned in a drain position permitting the transfer of contaminated fluids from the flexible hulled vessel to a vacuum receiver vessel.

FIG. 6 shows an illustrative boom apparatus 300 in the second position permitting the discharge of the contaminated fluid in the flexible hulled vessel 205 to the vacuum receiver vessel 302 via a fluid conduit connection fluidly coupling the flexible hulled vessel 205 to the vacuum receiver vessel 302. In at least some instances, the fluid conduit coupling the flexible hulled vessel 205 to the vacuum receiver vessel 302 can include a rigid wall flexible hose that is rated for vacuum service. In the second position, the flexible hulled vessel 205 is suspended in a vertical or near vertical position that permits the contaminated fluid within the flexible hulled vessel 205 to flow to the region proximate the flow direction apparatus 100 for withdrawal. Advantageously, submersion of the flow direction apparatus 100 in the contaminated fluid permits the withdrawal of the contaminated fluid from the flexible hulled vessel 205 without collapsing the flexible hulled vessel 205 about the flow direction apparatus 100.

After the contaminated fluid is removed from the flexible hulled vessel 205, the vessel may be transported by the vehicle for use in a different location, or may be placed back on the ground proximate the vehicle by rotating the rotating frame 310 to the first position (ref., FIG. 4).

The above description of illustrated embodiments, including what is described in the Abstract, is not intended to be exhaustive or to limit the embodiments to the precise forms disclosed. Although specific embodiments of and examples are described herein for illustrative purposes, various equivalent modifications can be made without departing from the spirit and scope of the disclosure, as will be recognized by those skilled in the relevant art. The teachings provided herein of the various embodiments can be applied to other containment systems, not necessarily the exemplary TSB installed system generally described above.

The various embodiments described above can be combined to provide further embodiments. Aspects of the embodiments can be modified, if necessary, to employ systems, structures and concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The various embodiments described above can be combined to provide further embodiments. To the extent that they are not inconsistent with the specific teachings and definitions herein, both U.S. Provisional Patent Application Ser. No. 61/568,036, filed Dec. 7, 2011 and U.S. Provisional Patent Application Ser. No. 61/671,534, filed Jul. 13, 2012 are incorporated herein by reference, in their entirety. Aspects of the embodiments can be modified, if necessary, to employ systems, circuits and concepts of the various patents, applications and publications to provide yet further embodiments.

The invention claimed is:

1. A system for collection, containment, and disposal of contaminated fluids, the system comprising:

a flexible hulled containment vessel having at least one resilient deformable wall which forms an interior compartment of the containment vessel, the containment vessel including a port to provide access between the interior compartment and an exterior of the containment vessel;

a coupler positioned about the port that provides detachable but sealing fluid coupling to evacuate a stream of contaminated fluid from within the containment vessel;

a flow directing apparatus having a body having a proximal end, a distal end, a passage extending between the proximal and distal ends, the body having an exterior opening at the proximal end, and at least two apertures sequentially spaced along the body toward the distal end relative to the proximal end with a bridge formed between successive ones of the apertures, the apertures each dimensioned to receive solids found in the contaminated fluids, the body having an outer perimeter sized to be received through the port into the interior compartment of the containment vessel, a portion of the flow directing apparatus sized and configured to detachably sealingly couple to the coupler when at least a portion of the body is positioned through the port into the interior compartment of the containment vessel; and an exterior portal coupled to the body proximate the proximal end of the body to provide fluid passage therebetween, the exterior portal having a vacuum hose coupler which provides selectively releasable coupling to a sewage vacuum truck hose, wherein the exterior portal has a first diameter and the body has a second diameter, the second diameter greater than the first diameter.

2. The system of claim 1 wherein the apertures are circumferentially aligned with one another about a principal axis of the body.

3. The system of claim 1 wherein the apertures are circumferentially offset with respect to one another about a principal axis of the body.

4. The system of claim 1 wherein the body has an interior opening proximate the distal end.

5. The system of claim 1, further comprising:

a thermally insulating material disposed over at least a portion of the resilient deformable wall of the containment vessel.

6. A system for collection, containment, and disposal of contaminated fluids, the system comprising:

a flexible hulled containment vessel having at least one resilient deformable wall which forms an interior compartment of the containment vessel, the containment vessel including a port to provide access between the interior compartment and an exterior of the containment vessel;

a coupler positioned about the port that provides detachable but sealing fluid coupling means, for evacuating to evacuate a stream of contaminated fluid from within the containment vessel; and a flow directing apparatus having a body having a proximal end, a distal end, a passage extending between the proximal and distal ends, the body having an exterior opening at the proximal end and an interior opening proximate the distal end, and at least two apertures sequentially spaced along the body toward the distal end relative to the proximal end with a bridge formed between successive ones of the apertures, the apertures each dimensioned to receive solids found in the contaminated fluids, the body having an outer perimeter sized to be received through the port into the interior compartment of the containment vessel, a portion of the flow directing apparatus sized and configured to detachably sealingly couple to the coupler when at least a portion of the body is positioned through the port into the interior compartment of the containment vessel, wherein the interior opening is coincident with a distal most one of the apertures.

7. A system for collection, containment, and disposal of contaminated fluids, the system comprising:

a flexible hulled containment vessel having at least one resilient deformable wall which forms an interior compartment of the containment vessel, the containment vessel including a port to provide access between the interior compartment and an exterior of the containment vessel;

a coupler positioned about the port that provides detachable but sealing fluid coupling to evacuate a stream of contaminated fluid from within the containment vessel;

a flow directing apparatus having a body having a proximal end, a distal end, a passage extending between the proximal and distal ends, the body having an exterior opening at the proximal end, and at least two apertures sequentially spaced along the body toward the distal end relative to the proximal end with a bridge formed between successive ones of the apertures, the apertures each dimensioned to receive solids found in the contaminated fluids, the body having an outer perimeter sized to be received through the port into the interior compartment of the containment vessel, a portion of the flow directing apparatus sized and configured to detachably sealingly couple to the coupler when at least a portion of the body is positioned through the port into the interior compartment of the containment vessel; and at least one heater element physically and thermally coupled to the resilient deformable wall of the containment vessel.

8. The system of claim 7, further comprising:

an electrical cable electrically coupled to the at least one heater element.

9. The system of claim 7, further comprising:

a thermally insulating material disposed over the at least one heater element.

10. The system of claim 1 wherein a length of the body between the proximal and the distal ends is less than 30 inches.

11. A flow directing system for use with a flexible hulled containment vessel from having an interior compartment to receive, contain and dispose of contaminated fluids, the flow directing apparatus comprising:

an exterior portal located exterior to the interior compartment in use, the exterior portal having a vacuum hose coupler sized and configured to provide selectively releasable coupling to a sewage vacuum truck hose; and a body having a proximal end, a distal end, a passage extending between the proximal and distal ends, the body having an exterior opening at the proximal end, and at least two apertures sequentially spaced along the body toward the distal end relative to the proximal end with at least one bridge that extends between successive ones of the apertures, the apertures each dimensioned to receive solids found in the contaminated fluids, the body having an outer perimeter sized to be received through a port into the interior compartment of the containment vessel in use, the passage of the body fluidly coupled to the exterior portal, wherein the exterior portal has a first diameter and the body has a second diameter, the second diameter greater than the first diameter.

12. The system of claim 11 wherein the apertures are circumferentially aligned with one another about a principal axis of the body.

13. The system of claim 11 wherein the apertures are circumferentially offset with respect to one another about a principal axis of the body.

14. The system of claim 11 wherein the body has an interior opening proximate the distal end.

15. The system of claim 14 wherein the interior opening is coincident with a distal most one of the apertures.

16. The system of claim 11 wherein a length of the body between the proximal and the distal ends is less than 30 inches.

* * * * *